US011020306B2

(12) United States Patent
Van Gelder

(10) Patent No.: US 11,020,306 B2
(45) Date of Patent: Jun. 1, 2021

(54) UNWEIGHTING DEVICES

(71) Applicant: Dynamic Movement Frameworks, LLC, Rockford, MI (US)

(72) Inventor: Leonard Van Gelder, Rockford, MI (US)

(73) Assignee: Dynamic Movement Frameworks, LLC, Rockford, MI (US)

( * ) Notice: Subject to any disclaimer, the term of this patent is extended or adjusted under 35 U.S.C. 154(b) by 65 days.

(21) Appl. No.: 16/208,973

(22) Filed: Dec. 4, 2018

(65) Prior Publication Data

US 2019/0167503 A1 Jun. 6, 2019

Related U.S. Application Data

(60) Provisional application No. 62/594,280, filed on Dec. 4, 2017.

(51) Int. Cl.

| | |
|---|---|
| ***A61H 1/02*** | (2006.01) |
| ***A61H 3/00*** | (2006.01) |
| ***A63B 21/055*** | (2006.01) |
| ***A63B 21/04*** | (2006.01) |

(Continued)

(52) U.S. Cl.

CPC ..... *A61H 1/0229* (2013.01); *A61H 1/0292* (2013.01); *A61H 3/008* (2013.01); *A61H 1/0274* (2013.01); *A61H 2003/007* (2013.01); *A61H 2201/1652* (2013.01); *A61H 2203/0406* (2013.01); *A63B 21/0442* (2013.01); *A63B 21/0552* (2013.01); *A63B 21/4001* (2015.10); *A63B 23/0464* (2013.01)

(58) Field of Classification Search

CPC .... A61H 1/0229; A61H 1/0292; A61H 3/008; A61H 2003/007; A61H 2203/0406; A61H 2201/1652; A61H 1/0274; A63B 23/0464; A63B 21/0552; A63B 21/0442; A63B 21/4001; A63B 69/24; A63B 69/26; A63B 7/00

See application file for complete search history.

(56) References Cited

U.S. PATENT DOCUMENTS 2,675,856 A * 4/1954 Abdallah ..... A61H 3/008 482/69
2,812,010 A * 11/1957 Abdallah ..... A61H 3/008 482/69

(Continued)

FOREIGN PATENT DOCUMENTS

RU 2560511 C2 8/2015

*Primary Examiner* — Nyca T Nguyen
(74) *Attorney, Agent, or Firm* — The Dobrusin Law Firm, PC

(57) ABSTRACT

An unweighting device of the present specification. The unweighting device generally includes a standalone cage system having a rail, or a plurality of rails, allowing a user to connect thereto. The user of the unweighting system wears a harness. The harness connect to a plurality of flexible bands which connect directly to a roller subassembly. The roller subassembly, which connects to the rail or rails of the cage, allow the user to move in a lateral direction. The bands connected to the user allow the user to move in an up and down direction thereby, when combined with the rolling movement, provide for dynamic movement of the user when using the unweighting device.

5 Claims, 7 Drawing Sheets

(51) Int. Cl.
*A63B 21/00* (2006.01)
*A63B 23/04* (2006.01)

(56) References Cited

U.S. PATENT DOCUMENTS 2,819,755 A * 1/1958 Berger ..... A61H 3/008 482/69
3,780,663 A * 12/1973 Pettit ..... A61G 7/1051 104/307
3,869,021 A 3/1975 Sutherland
4,303,041 A 12/1981 Thompson
4,569,352 A * 2/1986 Petrofsky ..... A61N 1/36003 607/49
6,190,342 B1 * 2/2001 Taylor ..... A61F 5/026 602/19
6,315,138 B1 * 11/2001 Dyson ..... A61G 7/1015 104/89
6,464,208 B1 * 10/2002 Smith ..... A61H 3/008 212/97
6,890,288 B2 5/2005 Bingham
7,255,666 B2 * 8/2007 Cardenas ..... A61H 1/0229 482/143
7,462,138 B2 12/2008 Shetty
7,883,450 B2 * 2/2011 Hidler ..... A61H 3/008 482/69
8,480,602 B1 * 7/2013 Cook ..... A63B 22/0235 601/35
8,746,739 B2 * 6/2014 Meggs ..... A61G 7/1042 280/748
2002/0026130 A1 * 2/2002 West ..... A61H 1/0262 601/23
2005/0192159 A1 9/2005 Jackson
2007/0004567 A1 * 1/2007 Shetty ..... A61H 3/008 482/69
2010/0000546 A1 * 1/2010 Park ..... A63B 69/0064 128/845
2011/0207586 A1 * 8/2011 Whyatt ..... A63B 21/4017 482/139
2013/0327591 A1 * 12/2013 Galpin ..... A62B 35/0043 182/3
2014/0201905 A1 * 7/2014 Glukhovsky ..... A61G 7/1049 5/81.1 R
2014/0206503 A1 * 7/2014 Stockmaster ..... A61H 3/008 482/4
2014/0223661 A1 * 8/2014 Galloway ..... A61G 7/1078 5/85.1
2015/0143627 A1 * 5/2015 McBride ..... A61H 3/008 5/81.1 R
2015/0320632 A1 * 11/2015 Vallery ..... A61G 7/1061 482/69
2015/0328078 A1 * 11/2015 Meuleman ..... A61H 3/008 482/79
2016/0045778 A1 * 2/2016 Dwork ..... A63B 23/1227 482/96
2016/0256346 A1 9/2016 Stockmaster
2016/0256725 A1 * 9/2016 Verdi ..... A63B 21/4003
2017/0035643 A1 * 2/2017 Workman ..... A61H 3/008

* cited by examiner

UNWEIGHTING DEVICES

TECHNICAL FIELD

The present specification generally relates to an apparatus for assisting with physical therapy and, more specifically, and apparatus for assisting with physical therapy, movement, fitness and/or wellness using unweighting to assist with movement of the user.

BACKGROUND

Unloading systems in general are known in the art to remove some of the weight as carried by a user for purposes of rehabilitation and/or training. However, these known systems are commonly robotic and thus much slower and cumbersome to the user. These system highly limit dynamic movement and motion. Alternative systems exist which are required to be mounted to a ceiling or other building structure. Accordingly, these systems are cost prohibitive to purchase.

While various systems are available to lift and relieve a portion of the weight carried by a user, these are cost prohibitive and do not allow for accurate and realistic dynamic movement of the user of the system Accordingly, a need exists for alternative apparatus for unweighting or unloading the bodyweight of a user which improved dynamic movement.

SUMMARY

In one embodiment, an unweighting apparatus is provided allowing a user positioned with feet on a ground level to be at least partially suspended, the apparatus comprising at least one rail supported in a position spaced apart from the ground, the at least one rail having at least one supporting surface, a roller movably slidably connected to the at least one rail, the roller subassembly comprising a plurality of rollers adapted to connect with and roll on said at least one supporting surface, the plurality of rollers configured to allow lateral movement along the at least one rail, a support bar connected to and hanging from the roller subassembly, the support bar configured to move rotationally with respect to the roller subassembly so as to allow the user to be at least partially suspend the body weight of a use so as to allow the user to move dynamically.

In another embodiment, an unweighting apparatus is provided allowing a user positioned with feet on a ground level to be at least partially suspended, the apparatus comprising at least one rail supported in a position spaced apart from the ground, the at least one rail having at least one supporting surface, a roller movably slidably connected to the at least one rail, a support bar connected to and hanging from the roller subassembly, the support bar having at least one elastic cord connected to a harness, the harness configured to be worn by the user so as to allow the user to be at least partially suspend the body weight of a use so as to allow the user to move dynamically.

In another embodiment, a harness for supporting a user and for connecting to an unweighting device is provided, the harness comprising an upper portion configured to securely connect to the chest of a user, the upper portion including at least 1 connection point configured to connect to a plurality of elastic cords and a lower portion including a belt, knee supports and foot supports wherein the upper portion is separate and distinct from the upper portion so as to prevent unwanted riding up of the user's clothing.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
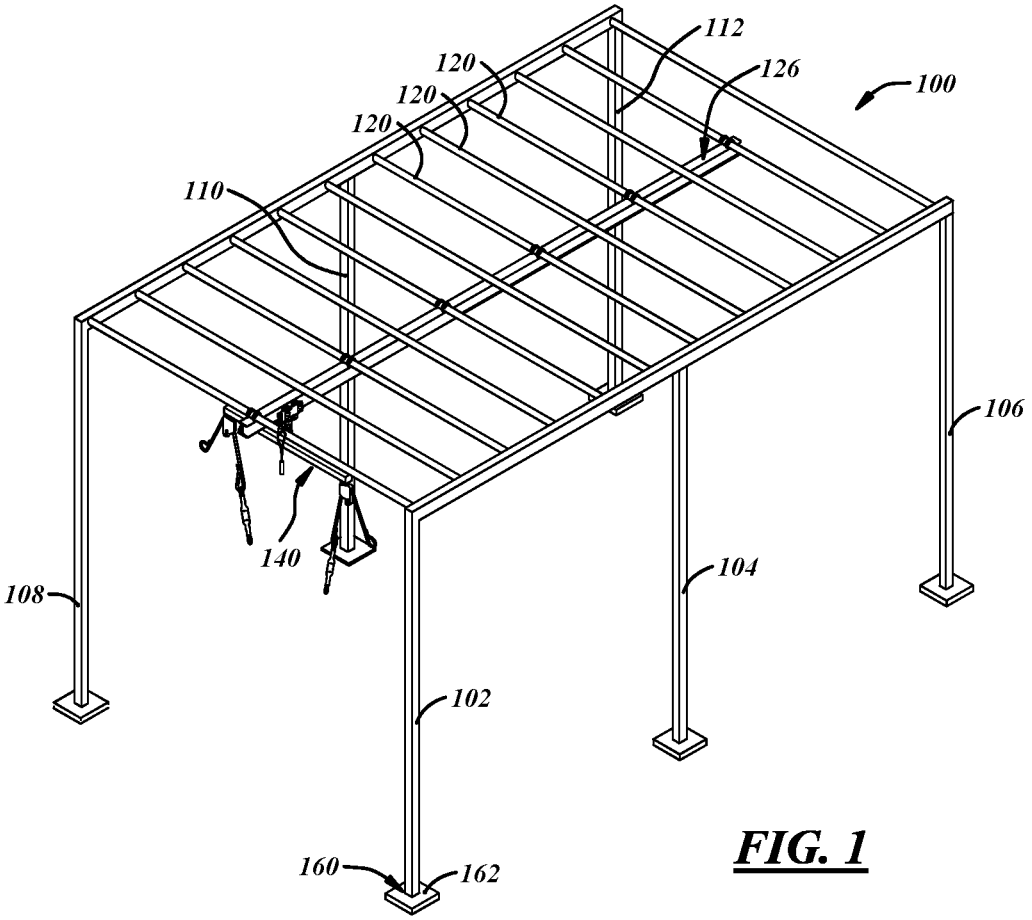
FIG. 1 depicts a perspective view of the unweighting device according to one or more embodiments shown and described herein.
Figure 2:
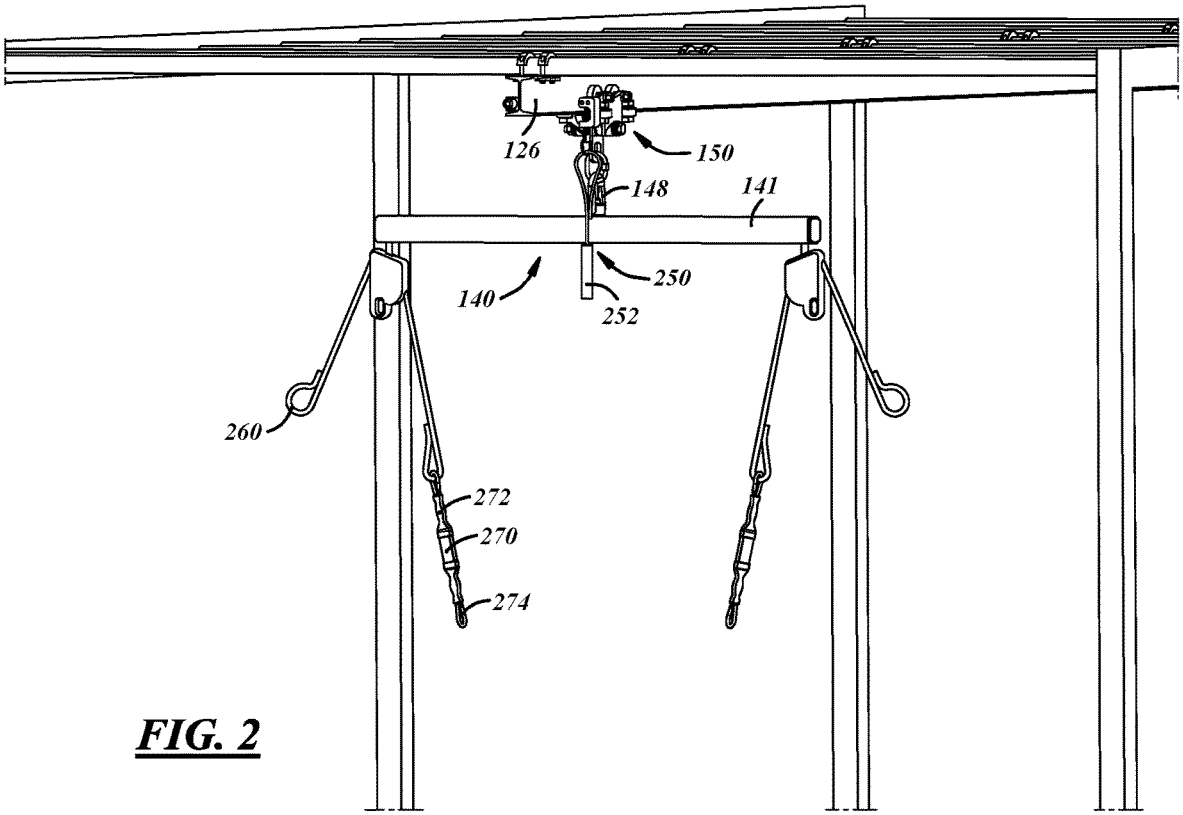
FIG. 2 depicts a close up perspective view of the cross bar unweighting device according to one or more embodiments shown and described herein.
Figure 3:
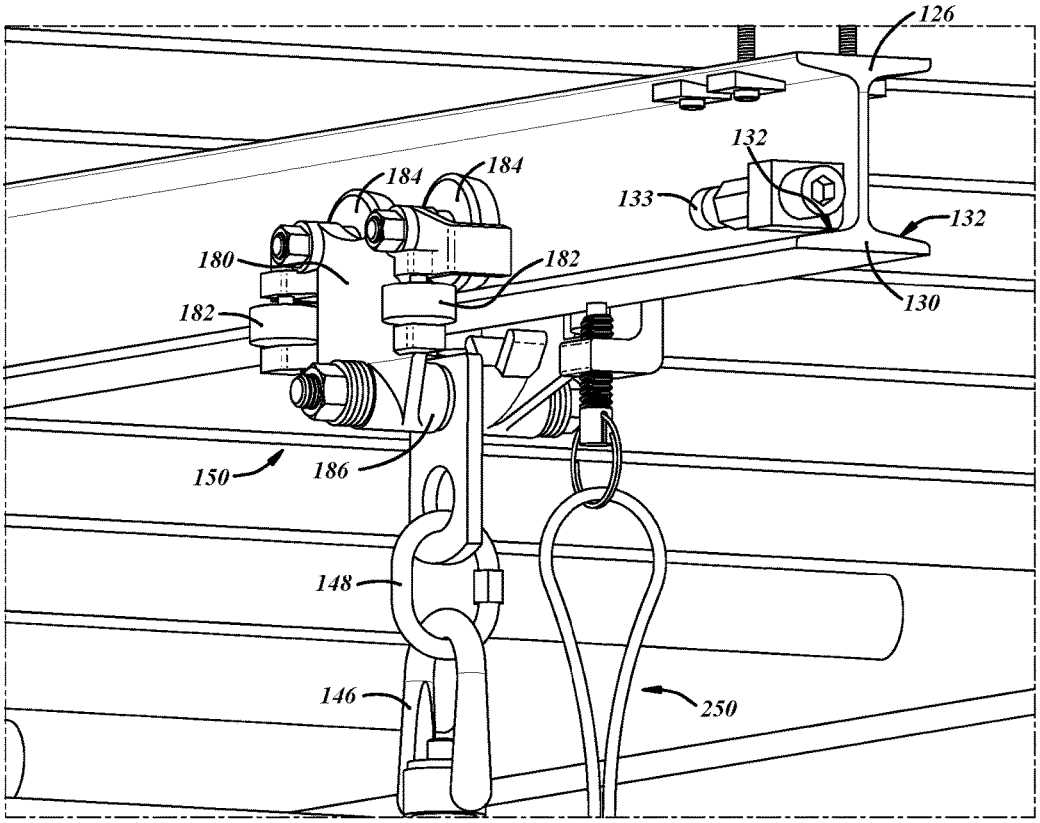
FIG. 3 depicts a close up photographic view of the roller subassembly unweighting device according to one or more embodiments shown and described herein.
Figure 4:
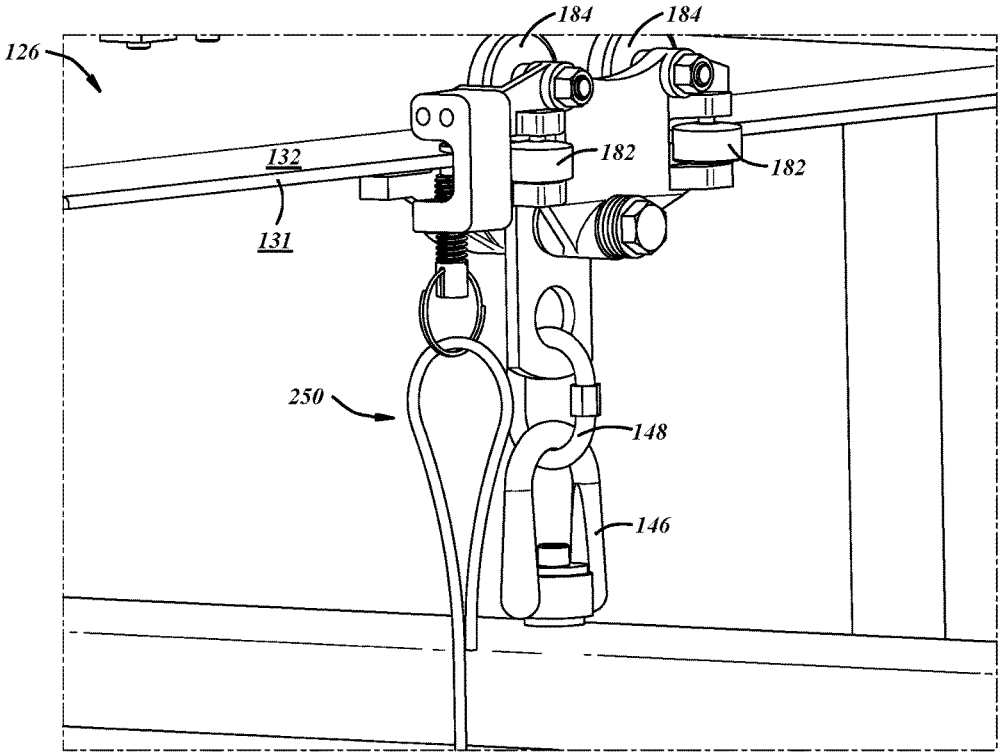
FIG. 4 depicts an alternative close up perspective view of the roller subassembly unweighting device according to one or more embodiments shown and described herein.
Figure 5:
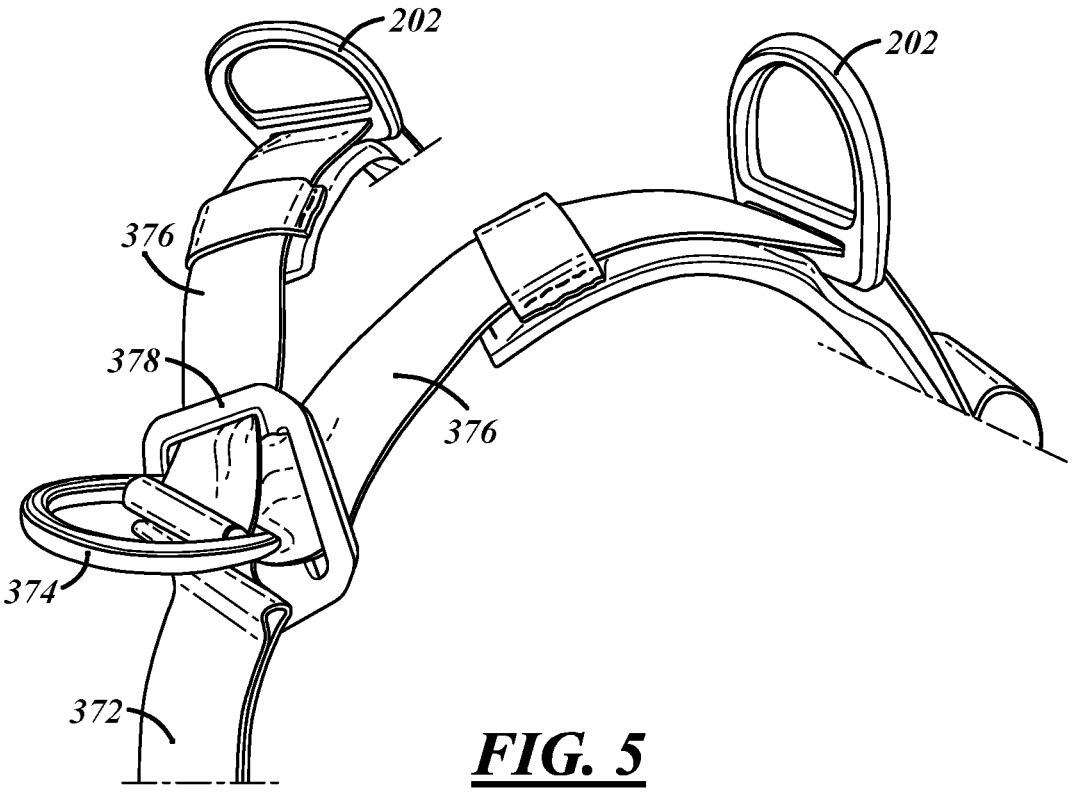
FIG. 5 depicts an a perspective view of the back portion of the upper harness illustrating multiple connection points according to one or more embodiments shown and described herein.
Figure 6:
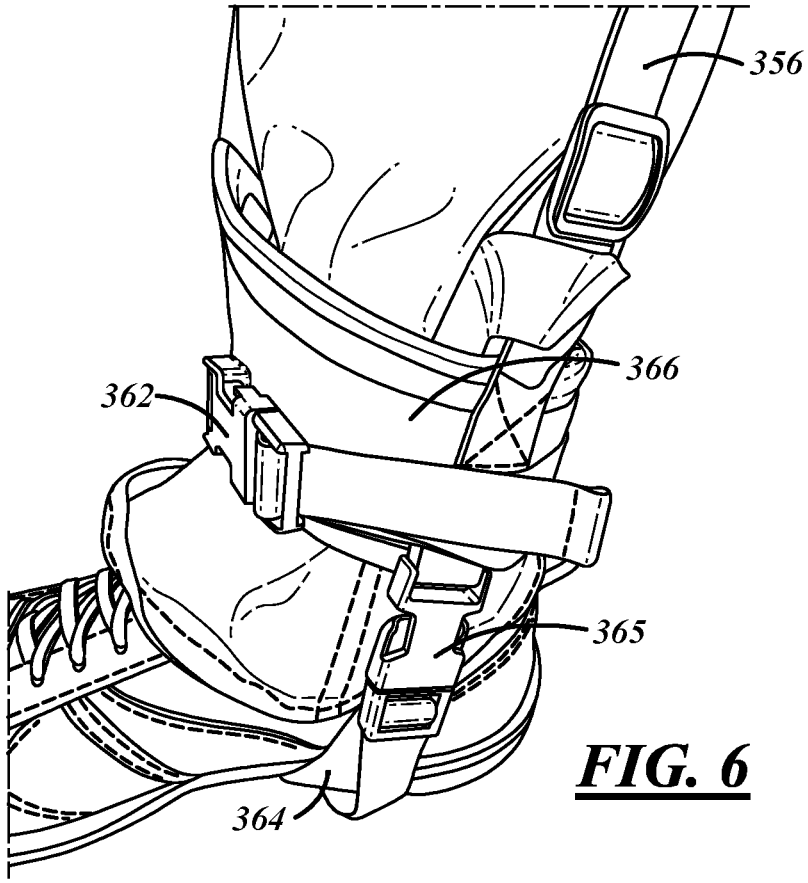
FIG. 6 depicts a close up perspective of the foot harness of the lower harness according to one or more embodiments shown and described herein.
Figure 7:
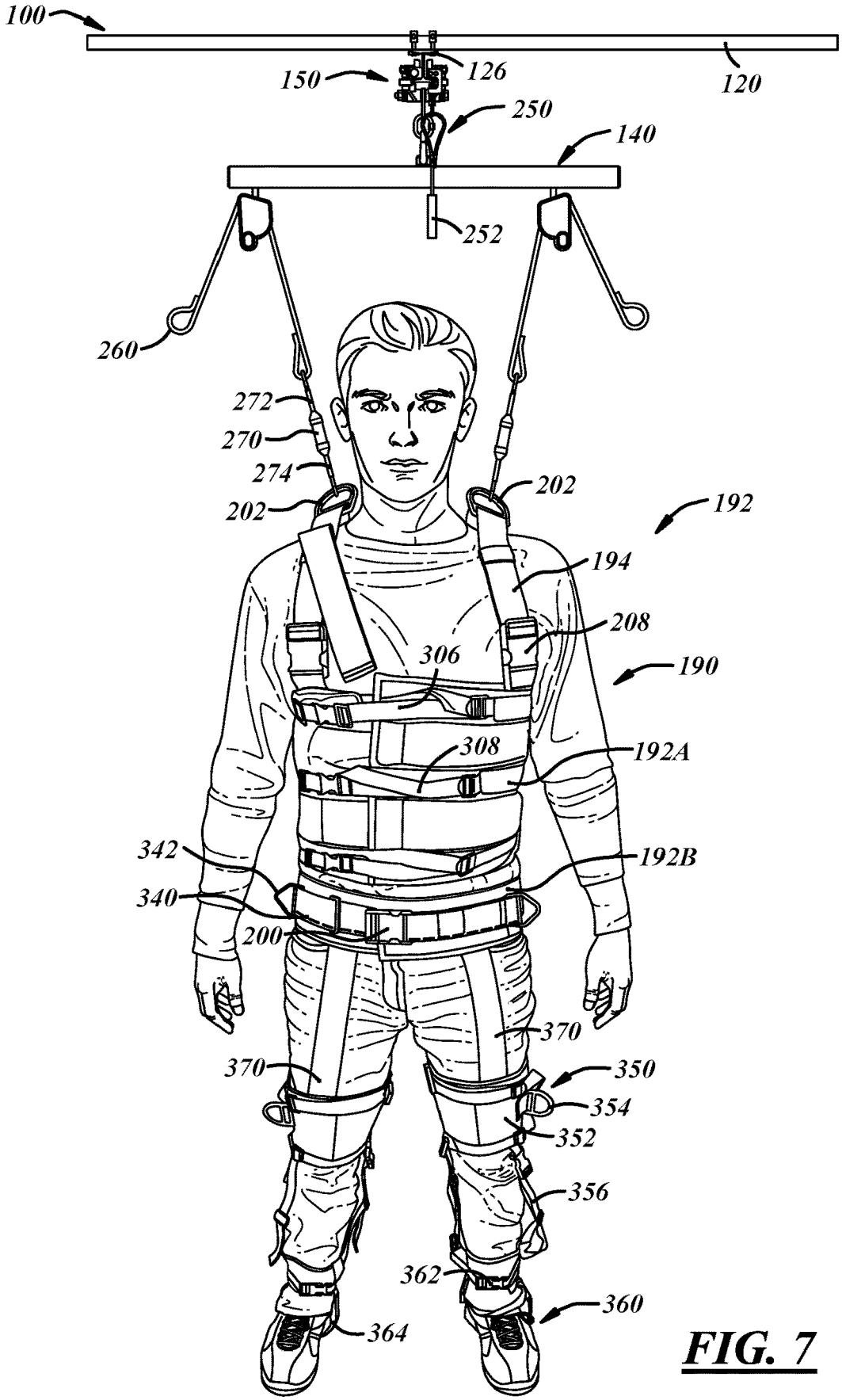
FIG. 7 depicts a front view of a user in a harness assembly and connected to the unweighting device according to one or more embodiments shown and described herein.
Figure 8:
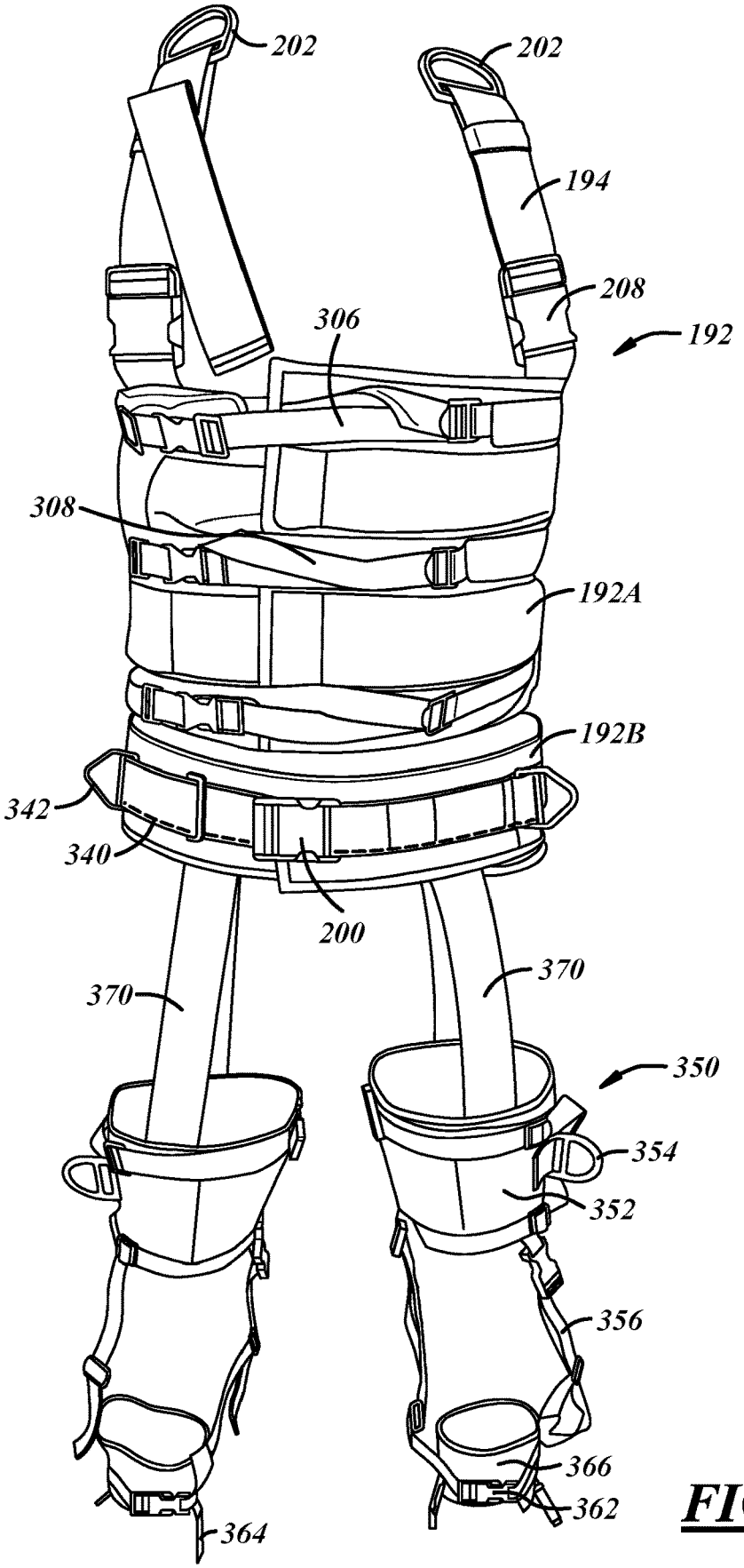
FIG. 8 depicts a front view of a harness assembly according to one or more embodiments shown and described herein.

FIG. 1 generally depicts the unweighting device of the present specification. The unweighting device generally includes a standalone cage system having a rail, or a plurality of rails, allowing a user to connect thereto. The user of the unweighting system wears a harness. The harness connect to a plurality of flexible bands which connect directly to a roller subassembly. The roller subassembly (or assembly), which connects to the rail or rails of the cage, allows the user to move in a lateral direction. The bands connected to the user allow the user to move in an up and down direction thereby, when combined with the rolling movement, provide for dynamic movement of the user when using the unweighting device.

The present system allows for a standalone bodyweight unloading system which allows for dynamic freedom of motion while still being in an unweighted state. The system provides for both the lower and upper body to be unloaded and to allow movement to be performed with less physical stress to the body. The standalone design allows movement professionals (such a physical therapists) to have the ability to reduce a person's body weight and body stress, which subsequently allows for ease of movement. The present system can be installed without significant modification to the building structure of a rehabilitation clinic or gym which is commonly necessary in other systems. Various embodiments of the unweighting device will be described in more detail herein.

Referring now to FIGS. 1-4, an unweighting device 100 is provided having a vertical support system. The vertical support system includes a plurality of generally vertical beams or supports 102, 104, 106, 108, 110, 112. The supports 102, 104, 106, 108, 110, 112 may include side supports (generally horizontal supports) which are positioned generally perpendicular to the supports 102, 104, 106, 108, 110, 112. The side supports are positioned generally parallel a plurality of cross beams 120.

The upper portion included the plurality of cross beams 120. The cross beams 120 extend between the sides of the unweighting 100. The cross beams 120 are positioned generally horizontal and include a roller system 150. The roller system 150 is configured to allow the user system (such as the harness to be discussed herein) thereto. The rails system includes a main rail 126 having an upper portion 128 and a lower portion 130. The main rail 126 is generally an I-beam. The main rail 126 is connected directly to the cross beams 120.

The main rail 126 includes the surfaces 132. The surfaces 132 are configured to allow the roller system 150 to roll thereon. The surface 132 are generally planar and are the upper surfaces of the lower portion 130 of the main rail (or I-beam) 126.

The roller system 150 rolls along the surfaces 132 during operation. The roller system 150 generally includes a plurality of wheels or rollers 182 positioned to roll having a generally vertical rotational axis and a plurality of wheels or rollers 184 positioned to roll having a generally horizontal rotational axis. Said rollers 182, 184 are clearly illustrated in FIGS. 3 and 4. Alternative embodiments of any roller system may be utilized including any form of sliding or roller mechanism which allows a user to move along the rail (or other supporting device).

The rollers 182 are configured to abut the side of the lower portion 130 of the main rail 126. The rollers 182 abut the surface of the lower portion 130 as the roller system 150 is moved. The rollers 184 are configured to abut the surfaces 132 of the lower portion 130. Opposing rollers corresponding to each roller are positioned on the opposite side of the main rail 126. The rollers 182, 182 are each supported by a pivot pin extending therethrough. Each of the rollers 182, 184 are support by a housing 180. The housing 180 as a whole is configured to move, with the help of the rollers 182, 184, back and forth contributing to the ability of dynamic movement of the user. A bumper 133 is also provided to stop the roller system 150 from moving off of the rail 126.

The roller system 150 connects to a cross bar 140. The cross bar 140 connects to a harness 192, which will described in additional detail herein. The cross bar 140 connects to the roller system 15 by means (a center connector) of a plurality of connection portions 148 and 148. The connection portion 146 may be configured so as to rotate or twist when the a user is in the harness thereby facilitating dynamic movement.

The cross bar 140 includes two distal ends. The harness connects to the cross bar 140 at the distal ends. Bungee members 270 are disposed connected to each distal end of the cross bar 140. The bungee members 270 include a first end 274 to connected to a harness and a second end 272 to connect to a manual tensioning member 260. The bungee members, or bungee bands, are industrial strength bands in shortened positions. These banks provide the unlading system disclosed herein stretch tension to the system which allows for free form dynamic movement. Various different lengths and/or strengths of bungee bands 270 may be utilized in the system.

The manual tensioning member 260 which connects the bungee bands 270 to the cross bar 140. The manual tensioning member 260 is a manual tensioning system for the industrial strength rubber bands, it is a self-locking device that will likely use rope or another flexible material over a roller system to pull on the proximal end of the band up to the framework. Since the cross bar above is fairly tall, an operator (not the user, but the person assisting the user) needed a way to easily attach the unloading bands safely and allow the person helping the individual, or the individual themselves, to place the tension on the bands using the tension pulley system without having to climb up to the cross bar itself.

A lock 250 is provided to keep the roller system in one position. It will insert a pin into a drilled opening in the I-beam to lock the roller system in one place.

The user 190 is supported by a harness 192. In this embodiment, the harness 192 is a two piece system including an upper portion 192A and a lower portion 192B. The upper portion 192A is a vest type harness including a plurality of straps, buckles and hooks. The lower portion 192B is a belt, knee and foot supporting system configured to reduce unwanted riding up for the user 190. The harness 192 includes a plurality of support straps 194, 196. The support straps 194 extend over the shoulders of the user 190. A support strap 194 extends over the shoulders of the user and is fastened by a buckle 208.

The upper portion 192A of the harness 192 includes a rear connection system positioned on the back of the user 190. A plurality of straps 176 extend from the front of the harness to the back generally forming a Y shape. A plurality of rings 374, 378 are provided allowing the user 190 to be further connected to the system thereby providing or dynamic movement. A strap 272 is also provided which extends down the back of the user and connects to a main portion of the vest.

The support strap 340 is connected by a first buckle 200. The support strap 340 extends around the waist of the user to secure the strap 340. A d-ring, or other hook, 342 is provided connected to the strap 340 and many be used to further support and/or manipulate the user 190 to facilitate dynamic movement. Supplemental support straps 306, 308 extend on the users back so as to provide for additional support to the user 190.

The harness 192 connects to the cross bar 140 by means of a plurality of cords, or bungee members 270. In the present embodiment, the cords 270 are bungee cords thereby providing for extreme resiliency and elasticity. The cords 270 connect directly to the harness 192 at the D-rings 202, 204. In other embodiments, the D-rings 202, 204 may be any suitable loop, hook or fastener suitable for connecting to the bungee members 270. The opposing ends of the bungee members 270 connect to the cross bar 140. Other suitable members having extreme resiliency to allow the user dynamic movement may alternatively be used.

The vest includes the lower portion 192B. The lower portion 192B includes a belt portion having a plurality of straps 370 extending to a knee portion 252. The knee portion 352 connects to the foot supports 360 by means of a connecting strap 356. The knee supports 352 include a base portion made of a cloth or other flexible material. A plurality of straps are provided to secure the knee portion 352 to the knee of the user.

The foot supports include a fabric or cloth base portion 366 and a plurality of straps 256 and buckles 362, 365. A foot strap 364 is provided to go under the foot of the user to support the foot of the user 190.

The cross bar 140 connects directly to the roller system 150. The cross bar 140 connects directly to the roller system 150 by means a plurality of the connection points 146, 148 which aid in allowing the user to move and twist when connected to the cross bar 140.

In other embodiments, the cords, or bungee members, 270 may have increased elasticity or decreased elasticity depending on the needs, training and/or rehabilitation demands of the user. The bungee members 270, when connected to the user 190, allow the user to move dynamically while still being at least partially unweighted.

The user 190, when connected to the bungee members 270, the cross bar 140 and the roller system 150, is able to move dynamically along the main rail 126. The roller system 150 provides for lateral movement, the cross bar 140 provides for rotational movement and the bungee members 270 provide for up and down movement. When combined, the movement of the user is fully dynamic.

In the present embodiments, the cage portions of the system are generally a strong metal such as steel or aluminum. In some embodiments, similar metals having comparable strength characteristics may be utilized. In other embodiments, plastics or polymers (or hybrid materials or co-extruded methods) are used to manufacture the cage so long as the materials exhibit similar strength characteristics.

The cross bar 140 is equally made of similar metals such as steel or aluminum. In some embodiments, similar metals having comparable strength characteristics may be utilized. In other embodiments, plastics or polymers (or hybrid materials or co-extruded methods) are used to manufacture the cross bar 140 so long as the materials exhibit similar strength characteristics. The other components described herein have materials similar or the same such as described above so as to properly enable use of the apparatus.

The system of the present specification works using the aforementioned overhead tracking and movement system allowing for forward and backward with 360 full degrees of freedom. While most other bodyweight unloading systems are extremely expensive and do not allow bodyweight support during dynamic tasks such as squatting, lunging, hopping, or jumping. The present system does allow for support during said dynamic movements.

The fully dynamic movement is particularly advantageous in that it provides for a more natural movement of the user 190. In this effect, the user can more easily walk, jump or otherwise move so as to mimic natural movement by being less confined to a pre-set space of movement. The dynamic movement yields improvement results in both rehabilitation and in training.

It is noted that the terms "substantially" and "about" may be utilized herein to represent the inherent degree of uncertainty that may be attributed to any quantitative comparison, value, measurement, or other representation.

These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter.

Moreover, although various aspects of the claimed subject matter have been described herein, such aspects need not be utilized in combination. It is therefore intended that the appended claims cover all such changes and modifications that are within the scope of the claimed subject matter.

What is claimed is:

1. An unweighting apparatus allowing a user positioned with feet on a ground level to be at least partially suspended, the apparatus comprising:

at least one rail supported in a position spaced apart from the ground, the at least one rail having at least one supporting surface, the supporting surface being horizontal;

a roller subassembly movably slidably connected to the at least one rail, the roller subassembly slidable on the horizontal supporting surface thereby providing for lateral movement of the roller subassembly;

a support bar connected to and hanging from the roller subassembly, the support bar configured to move rotationally with respect to the roller subassembly, the support bar having a center connector, the center connector of the support bar connected to the roller subassembly, the support bar having two distal ends;

the support bar having a pair of bungee members connected thereto, each of the pair of bungee members connected to opposing distal ends of the support bar, each of the bungee members connected to a harness at the shoulders of the user, each of the bungee members of the pair of bungee members includes a manual tensioning member connected thereto, the manual tensioning member connecting each bungee member to each of the distal ends of the support bar, the harness configured to be worn by the user so as to allow the user to be at least partially suspend the body weight of the user so as to allow the user to move dynamically.

2. The unweighting apparatus of claim 1 wherein the harness includes an upper portion and a lower portion.

3. The unweighting apparatus of claim 2 wherein the upper portion is configured to securely connect to the chest of the user, the upper portion including at least one connection point configured to connect to the plurality of bungee members.

4. The unweighting apparatus of claim 2 wherein the lower portion includes a belt, knee supports and foot supports.

5. The unweighting apparatus of claim 1 wherein the rail is connected to a frame, the frame being freestanding.

* * * * *